United States Patent [19]

Shiramizu

[11] Patent Number: 4,537,108

[45] Date of Patent: Aug. 27, 1985

[54] ELECTRONIC MUSICAL INSTRUMENT HAVING VARIABLE FREQUENCY DIVIDERS

[75] Inventor: Takami Shiramizu, Kanagawa, Japan

[73] Assignee: Victor Company of Japan, Limited, Yokohama, Japan

[21] Appl. No.: 480,128

[22] Filed: Mar. 29, 1983

[30] Foreign Application Priority Data

Mar. 31, 1982 [JP] Japan ..... 57-51308

[51] Int. Cl.[3] ..... G10H 1/00

[52] U.S. Cl. ..... 84/1.01; 84/DIG. 11

[58] Field of Search ..... 84/1.01, DIG. 11; 377/47, 48, 108, 110; 328/16

[56] References Cited

U.S. PATENT DOCUMENTS

| | | | |
|---|---|---|---|
| 3,842,702 | 10/1974 | Tsundoo . | |
| 3,916,322 | 10/1975 | Nelson | 84/DIG. 11 |
| 4,016,495 | 4/1977 | Machanian | 377/110 |
| 4,215,616 | 8/1980 | Gross | 84/DIG. 11 |
| 4,216,691 | 8/1980 | Bean | 84/DIG. 11 |
| 4,328,731 | 5/1982 | Gotho et al. | 84/DIG. 11 |

FOREIGN PATENT DOCUMENTS

| | | |
|---|---|---|
| 0038675 | 10/1981 | European Pat. Off. . |
| 1407666 | 9/1975 | United Kingdom . |
| 2050035 | 12/1980 | United Kingdom . |
| 2079998 | 1/1982 | United Kingdom . |

OTHER PUBLICATIONS

Lancaster, CMOS Cookbook, 1977, pp. 288–289.

*Primary Examiner*—Forester W. Isen

*Attorney, Agent, or Firm*—Cushman, Darby & Cushman

[57] ABSTRACT

An electronic musical instrument comprising a code generator responsive to the operation of each of the keys for generating a first code indicating a tone pitch and a second code indicating an octave associated with the operated key. A first variable frequency divider is presettable to a first count value as a function of the first code for counting master clock pulses supplied from an oscillator and generating a first divider output when the first count value is reached. A second variable frequency divider is presettable to a second count value as a function of the second code for counting the first divider output and generating a plurality of pulse trains having octave frequency relationship. A digital-to-analog converting means is provided for converting the pulse trains into an analog signal.

14 Claims, 9 Drawing Figures

FROM OSC 28
40
a
30
41
42
43
44
45
46
47
48
b
c
d
e
f
g
h
i
49
j
51
52
53
k
l
m
TO VFD 32
55
56
57
58
59
60
70
71
72
73
74
75
76
77
78
79
1
2
3
4
5
6
7
8
9
FROM ROM 24
STROBE FROM TMG CCT 19
RESET

ELECTRONIC MUSICAL INSTRUMENT HAVING VARIABLE FREQUENCY DIVIDERS

BACKGROUND OF THE INVENTION

The present invention relates to an electronic musical instrument having a tone generator of simplified circuit configuration.

Conventional electronic organs generally comprise a tone generator for generating a plurality of octave tone signals, a keying unit associated with the keyboard for selecting an octave signal in response to a struck key and a filter unit through which the keyed signal is applied to a speaker or speakers. The prior art tone generator comprises an oscillator, a plurality of first frequency dividers each of which is coupled to the oscillator for generating a tone of definite pitch so that a set of tones from C# note to C note is simultaneously generated from the tone generator. Associated with each of the first frequency dividers is a series of interconnected divide-by-two counters for dividing the frequency of the generated tone in succession to generate a set of octave tones. Through a connecting network the octave tone signals of each note are applied to plural keying circuits which, in response to the information from the keyboard, generates 2' (feet), 4', 8' and 16' signals.

Because of the great number of circuit components required to build the tone generator and the keying unit and because of the simultaneous generation of various tones, the prior art electronic organ is expensive to manufacture and consumes a substantial amount of energy. Since for most musical performances only a few notes are usually required at a given instant, the circuits are not efficiently utilized and a substantial part of the tone generating energy is wasted.

Attempts have hitherto been made to simplify the electronic circuit of the organ. However, no satisfactory results have been achieved.

SUMMARY OF THE INVENTION

Accordingly, the present invention has an object of providing an electronic musical instrument which is simple in circuit configuration, inexpensive in manufacture and highly efficient in operation.

The present invention contemplates the use of two variable frequency dividers for dividing the frequency of a master clock pulses by program inputs which are responsive to the note and octave information supplied from the keyboard.

The electronic musical instrument of the invention comprises a code generator responsive to the operation of each of the keys for generating a first code indicating a tone pitch and a second code indicating an octave associated with the operated key, an oscillator for generating master clock pulses at a constant frequency, a first variable frequency divider presettable to a first count value which is variable as a function of the first code for dividing the frequency of the master clock pulses by counting the pulses and generating a first divider output when the first count value is reached, and a second variable frequency divider presettable to a second count value which is variable as a function of the second code for dividing the frequency of the first divider output by counting it and generating a plurality of pulse trains having octave frequency relationship. Further provided is a digital-to-analog converting means for converting the pulse trains into an analog signal.

In a preferred embodiment of the invention, the first code includes an odd number signal and an even number signal respectively indicating that an integer by which the frequency of the master clock pulses is divided is odd or even. The first variable frequency divider preferably comprises first counter means including a series of interconnected presettable counter stages, or flip-flops, for counting the master clock pulses to generate an output pulse when the first count value is reached, second counter means for counting the master clock pulses upon a first occurrence of the output pulse of the first counter means for presetting the counter stages to the first count value when a first predetermined additional value is counted and upon a second occurrence of the said output pulse for presetting the counter stages to the first count value when a second predetermined additional value is counted. There is a difference of one count between the first and second predetermined additional values when the odd number signal is present and there is no difference therebetween in the presence of the even number signal. Bistable means is responsive to the said output pulse for generating the first divider output at a first voltage level in response to the first occurrence of the output pulse and at a second voltage level in response to the second occurrence of the output pulse and applying the first divider output to an input terminal of the second variable frequency divider.

The second variable frequency divider preferably comprises a series of interconnected flip-flops and means for selectively applying the first divider output to one of the flip-flops in response to the second code for generating a plurality of octave signals from the flip-flops.

BRIEF DESCRIPTION OF THE DRAWINGS

The present invention will be described in further detail with reference to the accompanying drawings, in which.

DETAILED DESCRIPTION

Figure 1A:
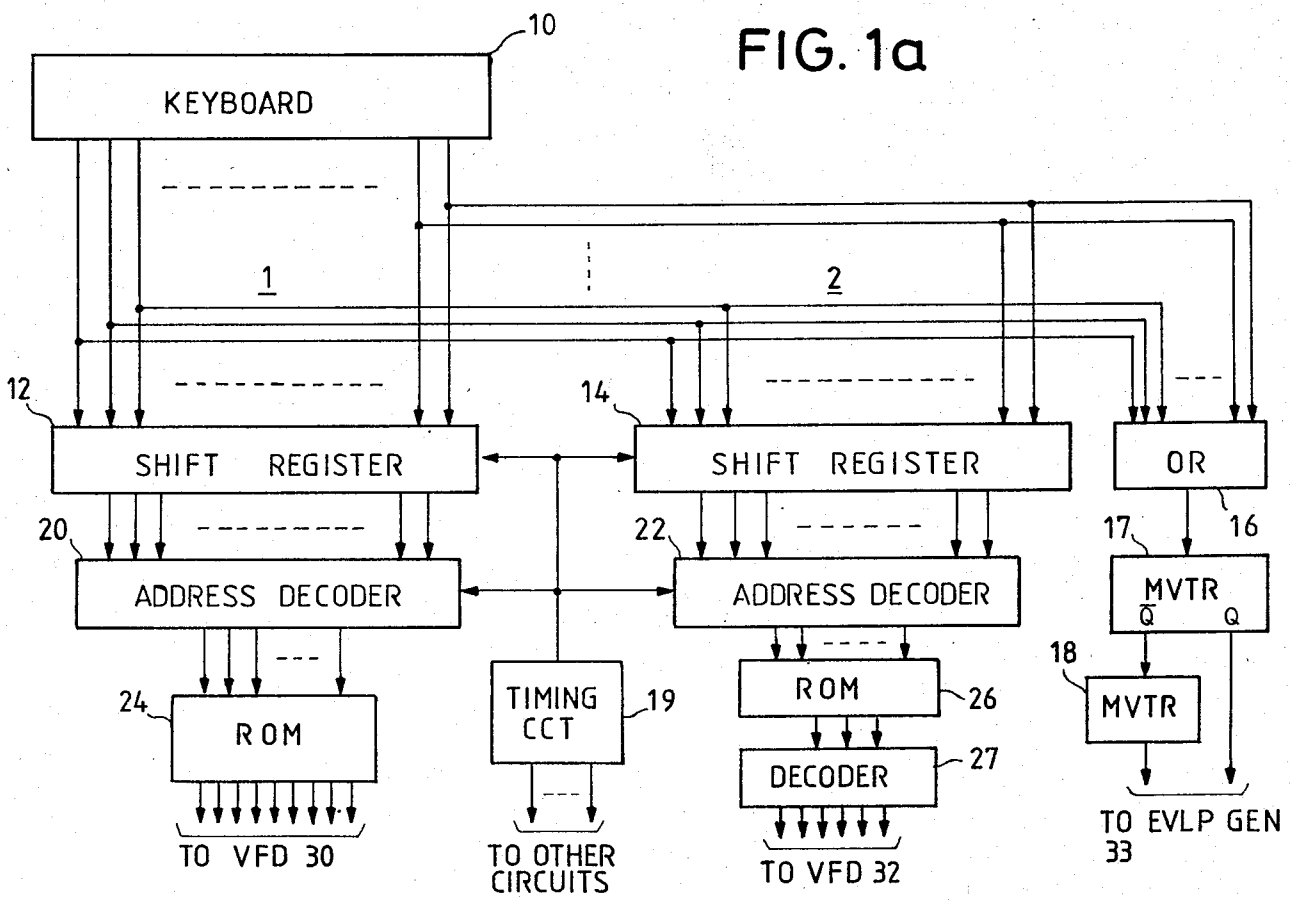
FIGS. 1*a* and 1*b* are schematic diagrams of the electronic organ of the invention.
Figure 1B:
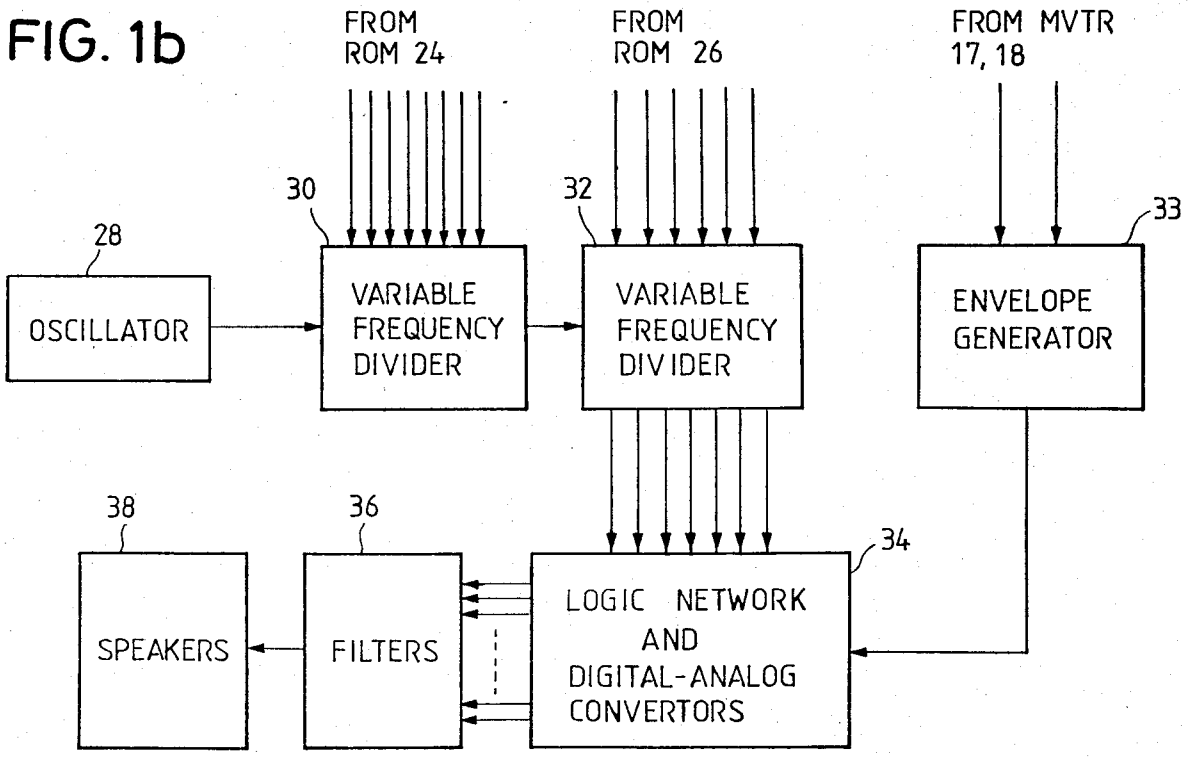

Referring now to FIGS. 1*a* and 1*b*, there is schematically shown a preferred embodiment of the electronic organ of the present invention. In FIG. 1*a*, a keyboard 10 is shown associated with a pitch tone control circuit 1 and an octave control circuit 2 each including a shift register, an address decoder and a read only memory. The individual keys of the keyboard 10 are respectively connected to corresponding bit positions of parallel-to-parallel shift registers 12 and 14 and to monostable multivibrators 17 and 18 via an OR gate 16.

The shift registers 12 and 14 are clocked by a timing circuit 19 to constantly monitor which key is operated to generate a "key-struck" signal. Address decoders 20 and 22, associated with the shift registers 12 and 14 respectively, are also clocked to translate the bit position of the operated key into a corresponding address code. The address code generated by decoder 20 is applied to a read only memory 24 in which 9-bit pitch tone data are stored in locations addressible by corresponding address codes. In a similar manner, the address code generated by decoder 22 is applied to a read only memory 26 in which 3-bit octave data are stored in location addressible by corresponding address codes. This 3-bit code is applied to a decoder 27 wherein its decoded into a one-out-of-six code. The timing circuit 19 generates various timing signals including clock and strobe pulses to other circuits of the system in a defined time sequence. It is preferable that a microcomputer be employed to control the various components of the system.

In FIG. 1*b*, there is provided a frequency stabilized oscillator 28 generating master clock pulses, typically at a frequency of 2.008448 MHz from which pulses of submultiple frequencies of this value are derived. The 2-MHz master clock is applied to a variable frequency divider 30 whose frequency dividing ratio is determinable by the 9-bit pitch tone code supplied from the read only memory 24 so that the output frequency of the divider 30 is the highest frequency of a series of octave signals. More specifically, th eight bits of the 9-bit pitch tone code indicate one of the twelve whole numbers by which the standard frequency is divided. These whole numbers include 239 for C note, 253 for B, 268 for A#, 284 for A, 301 for G#, 319 for G, 338 for F#, 358 for F, 379 for E, 402 for D#, 426 for D, and 451 for C#. One bit of the pitch note code indicates whether the whole number is odd or even.

The output of the variable frequency divider 30 is applied to a second variable frequency divider 32 whose frequency dividing ratio is determinable by the one-out-of six octave code supplied from the decoder 27. This one-out-of six code represents one of the eight whole numbers by which the highest frequency of the selected pitch is divided to obtain an octave tone. The output of the variable frequency divider 32 is applied to a logic network and DA converters 34 the outputs of which are applied to filters 36 and thence to loudspeakers 38. An envelope generator 33 is provided to receive a key-struck signal from the monostable multivibrators 17 and 18 to generate a waveform which is applied and combined with output signals from the DA converters 34.

Figure 2:
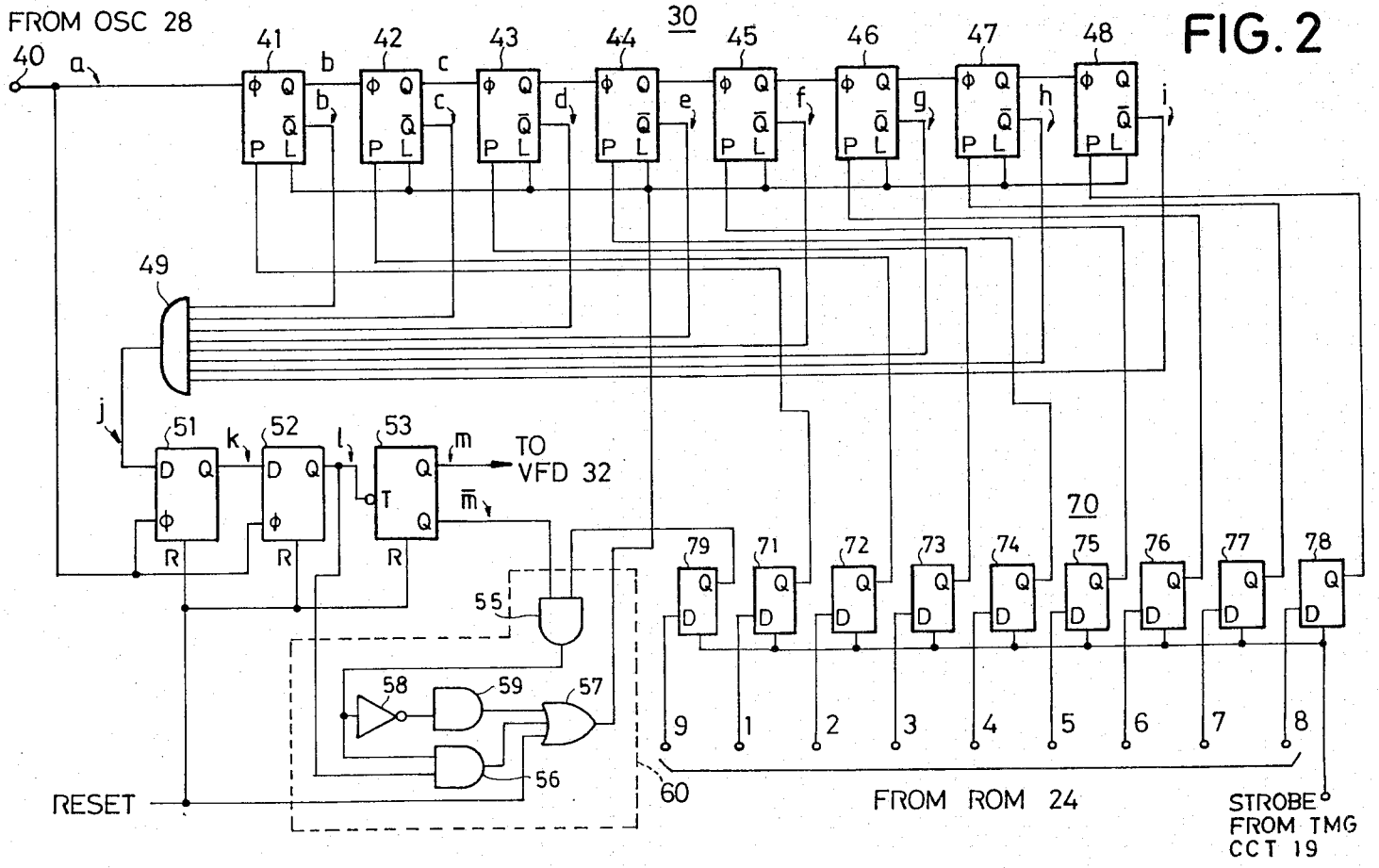
FIG. 2 is an illustration of the detail of the first variable frequency divider of FIG. 1*b;*
Figure 4:
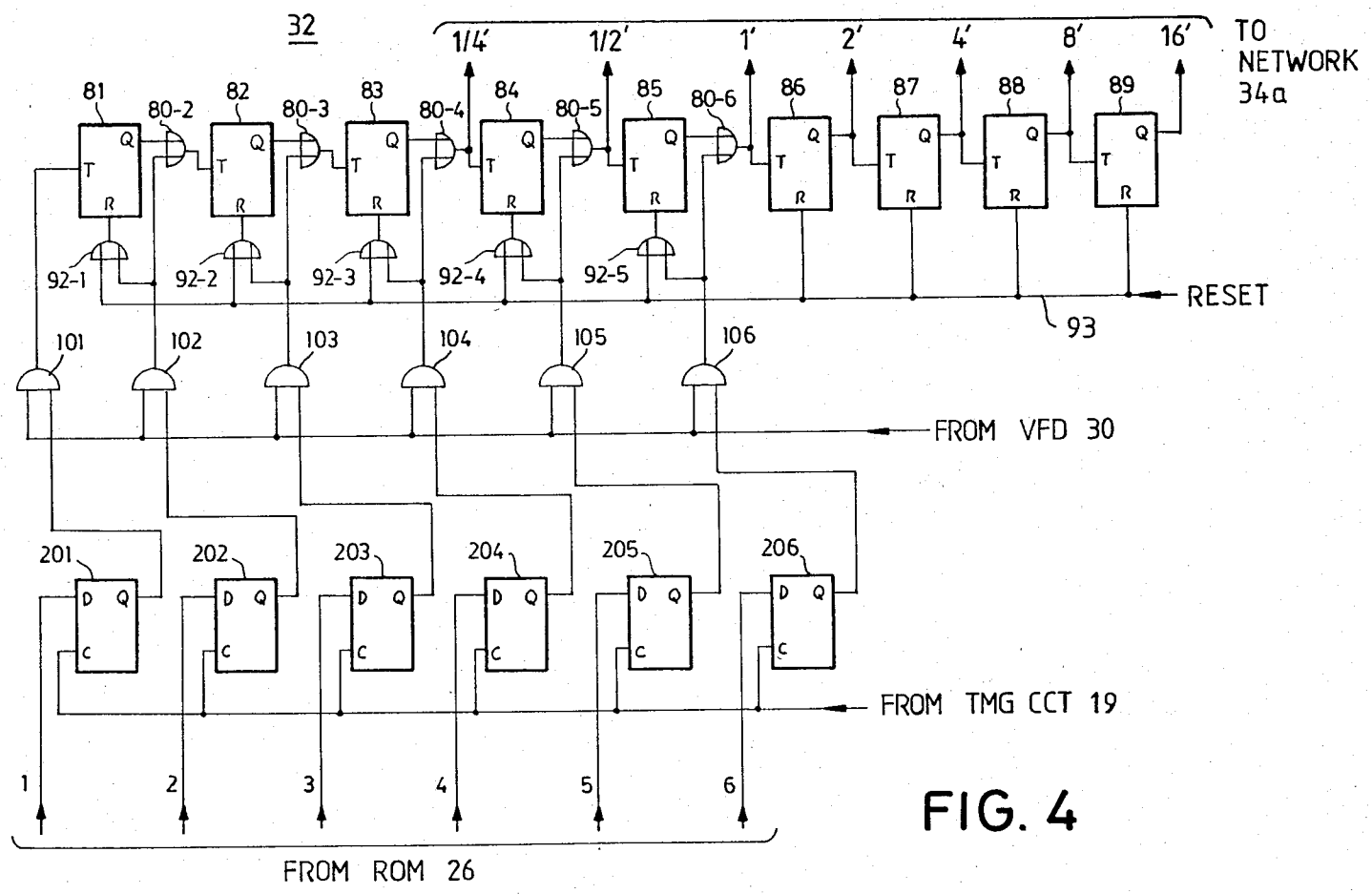
FIG. 4 is an illustration of the detail of the second variable frequency divider of FIG. 1*b;*

For a better understanding of the present invention, details of the variable frequency dividers 30 and 32 are illustrated in FIGS. 2 and 4, respectiely. In FIG. 2, the variable frequency divider 30 comprises a series of interconnected flip-flops 41 through 48 connected from an input terminal 40 to which the 2-MHz tone signal is supplied from the oscillator 28. The flip-flops 41 to 48 include preset termimals P coupled to corresponding output terminals of a latch 70 formed by a plurality of D flip-flops 71 to 79 in which the 9-bit pitch tone code from the read only memory 24 is latched. In response to a strobe pulse supplied from the timing circuit 19, the eight bits stored in the flip-flops 71 to 78 are applied to the corresponding preset terminals of the flip-flops 41 to 48. The flip-flops 41 to 48 have load-enable terminals L coupled together to the output of a resetting circuit 60 to load the 8-bit data from the latch 70 into the individual flip-flops to preset the counter to a digital whole number corresponding to the selected pitch tone. The resetting circuit 60 includes an OR gate 57 through which a reset pulse is applied when power is switched on. The complementary outputs of the flip-flops 41 to 48 are connected to inputs of an AND gate 49 to generate a coincidence signal when the preset value is counted.

In order to simplify the frequency dividing circuit when operating with an odd numbered denominator which would otherwise require a complicated 0.5 interval detector, the count period is divided into a first interval in which K pulses are counted and a second interval in which K+1 pulses are counted (where 2 K+1 equals the whole number N or denominator of the frequency division ratio). For this purpose, a shift register, formed by D flip-flops 51 and 52, are connected to the output of the coicidence gate 49 to introduce a certain amount of delay time in response to the count of the preset data which will be described in detail hereinafter. The output of the flip-flop 52 is connected to the toggle input of a T flip-flop 53 having its Q output connected to the input of the second variable frequency divider 32 and a complementary Q output connected to an AND gate 55 forming part of the resetting circuit 60. The AND gate 55 takes its other input from the flip-flop 79 of the latch 70. The flip-flop 79 is logical "1" to enable the AND gate 55 when the selected pitch tone is an odd number in order to provide one bit delay in the resetting circuit 60 immediately following the termination of the first interval of the count period and disable the AND gate 55 when the selected pitch tone is an even number. The resetting circuit 60 further includes an AND gate 56 which takes its inputs from the outputs of AND gate 55 and flip-flop 51 and an AND gate 59 taking an input from the output of the flip-flop 52 and its other input from the output of AND gate 55 via an inverter 58, the outputs of AND gates 56 and 59 being connected to inputs of the OR gate 57.

Figure 3:
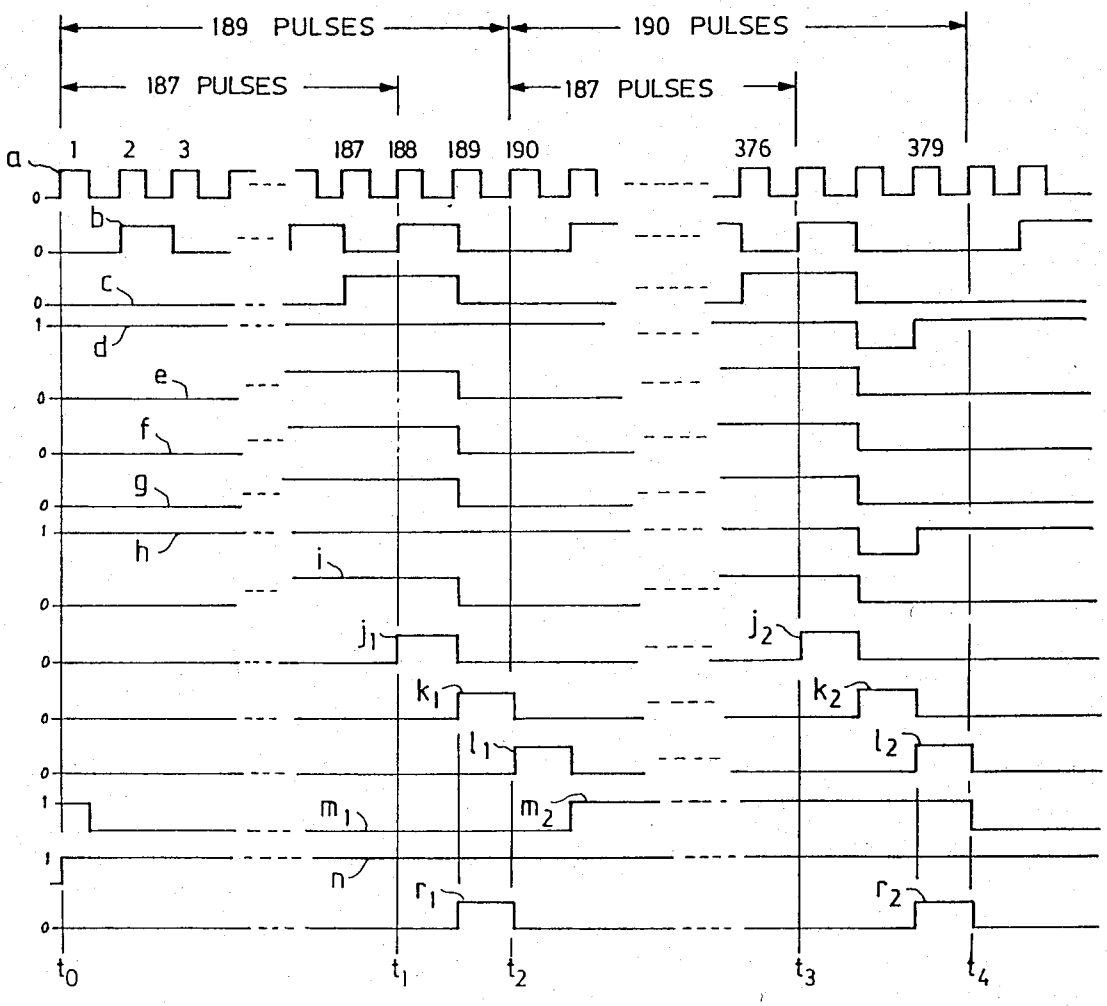
FIG. 3 is a timing diagram associated with the circuit of FIG. 2.

The operation of the variable frequency divider 30 will be understood by reference to FIG. 3. For purposes of illustration, it is assumed that the E note is struck on the keyboard 10 so that the variable frequency divider 30 operates to divide the 2-MHz master clock by a factor of 379. The count period is divided into a first interval of 189 count and a second interval of 190 count. For defining the two intervals and resetting the presettable flip-flops 41 to 48 at proper timing, these flip-flops are preset to $(N-m)/2$, where m is an odd or even number when N is an odd number or even number, respectively. Typically, m is set to 5 so that a preset value of 187 is read out of the read only memory 24 and stored in latch 70 and corresponding bits "10111011" are loaded into the flip-flops 41 to 48. As described above, a "1" bit is latched in flip-flop 79 and the AND gate 55 of resetting circuit 60 is enabled. The flip-flop 53 is in a first state in which its Q output is at a logical "0" and its complementary Q output is logical "1", so that AND gate 55 is activated to present a logical "1" to AND gate 56 and a logical "0" to AND gate 59.

The counter flip-flops 41–48 begins counting master clock pulses a at time $t_0$ successively generating pulses b, c, d, e, f, g, h and i from the respective flip-flop stages and when a count of 187 is reached at time $t_1$, a pulse $j_1$ is generated by the coincidence gate 49. In response to the 188th and 189th master clock trigger the flip-flops 51 and 52 in succession to generate pulses $k_1$ and $l_1$, respectively. In response to the leading edge of the pulse $k_1$, AND gate 56 switches to logical "1", generating a reset pulse $r_1$. Therefore, the counter flip-flops 41 to 48 are reset to the same preset value at the 189th master clock pulse to be in readiness to reinitiate the counting operation in response to the 190th master clock pulse at time $t_2$ which corresponds to the 1st count value of the second interval.

Concurrently, the T flip-flop 53 switches from the first state to a second state in which the Q output is at logical "1". Thus, the complementary output of flip-flop 53 is logical "0" and the AND gate 55 is disabled during the second count interval.

When the counter flip-flops counts 187 master clock pulses at time $t_3$, a coincidence output $j_2$ is generated and pulses $k_2$ and $l_2$ are successively generated in response to the 188th and 189th master clock pulses from the flip-flops 51 and 52, respectively. Since the AND gate 55 has been disabled, AND gate 59 is responsive to the leading edge of pulse $l_2$ to generate a second reset pulse $r_2$ to reset the counter flip-flops 41–48 at time $t_4$. This process will be repeated to supply a sequence of pulses $m_1$ and $m_2$ from the Q output of flip-flop 53 to the second variable frequency divider 32. It is seen that two master clock pulses are allowed during the interval between times $t_1$ and $t_2$ and three master clock pulses during the interval between times $t_3$ and $t_4$, and there is a total of five master clock pulses in addition to $187\times2$ clock pulses during the count period between times $t_0$ and $t_4$.

If N is an even number, the integer m is set to 6 and there is an equal number of counts in the first and second intervals. The flip-flop 79 is now latched to logical "0" so that AND gate 55 is no longer enabled. This allows the resetting circuit 60 to constantly respond to the output of flip-flop 52, rather than alternately responding to the outputs of flip-flops 51 and 52 as effected during the counting of an odd number. Therefore, three clock pulses are additionally counted in the period between times $t_1$ and $t_2$ as well as in the period between times $t_3$ and $t_4$.

Referring to FIG. 4, the variable frequency divider 32 comprises a presettable counter formed by a series of T flip-flops 81 to 89. The Q output of each preceding one of the flip-flops 81 to 85 is connected by an OR gate 80 to the toggle input of the next succeeding flip-flop. The Q output of each preceding one of the flip-flops 86 to 89 is connected directly to the toggle input of the next succeeding flip-flop. The flip-flops 81 to 85 are arranged to be reset by a pulse applied to a line 93 through an associated OR gate 92, while the flip-flops 86 to 89 have their reset terminals connected to the line 93. Each of the flip-flops 81 to 89 acts as a divide-by-two counter to generate a series of octave tone signals $\frac{1}{4}'$, $\frac{1}{2}'$, 1', 2', 4', 8' and 16' from the outputs of flip-flops 83 to 86.

The input signal from the variable frequency divider 30 is applied to first inputs of AND gates 101 to 106. The output of AND gate 101 is connected to the toggle input of flip-flop 81, while the outputs of AND gates 102 to 106 are connected via OR gates 80 to the toggle inputs of the flip-flops 82 to 86 respectively and also to the reset terminals of preceding flip-flops 81 to 85 via OR gates 92.

The one-out-of-six outputs of the decoder 27 are applied to a latch formed by a plurality of D flip-flops 201 to 206 whose outputs are respectively coupled to AND gates 101 to 106.

In response to a strobe pulse from the timing circuit 19 the data stored in flip-flops 201 to 206 are applied to the corresponding AND gates 101 to 106 to pass an input pulse from the variable frequency divider 30. If, for example, the one-out-of-six data is "000100", flip-flop 204 is loaded with a "1" bit and AND gate 104 is enabled to pass the pitch tone pulse from the variable frequency divider 30 to flip-flop 84, while resetting the preceding flip-flop 83. The input pulse is thus counted down by flip-flops 84 and 85 and applied to divide-by-two counters 86 to 89 in succession to generate a set of octave signals $\frac{1}{4}'$, $\frac{1}{2}'$, 1', 2', 4', 8' and 16' of the note associated with the struck key as shown in FIGS. 6*a* to 6*e*.

Figure 5:
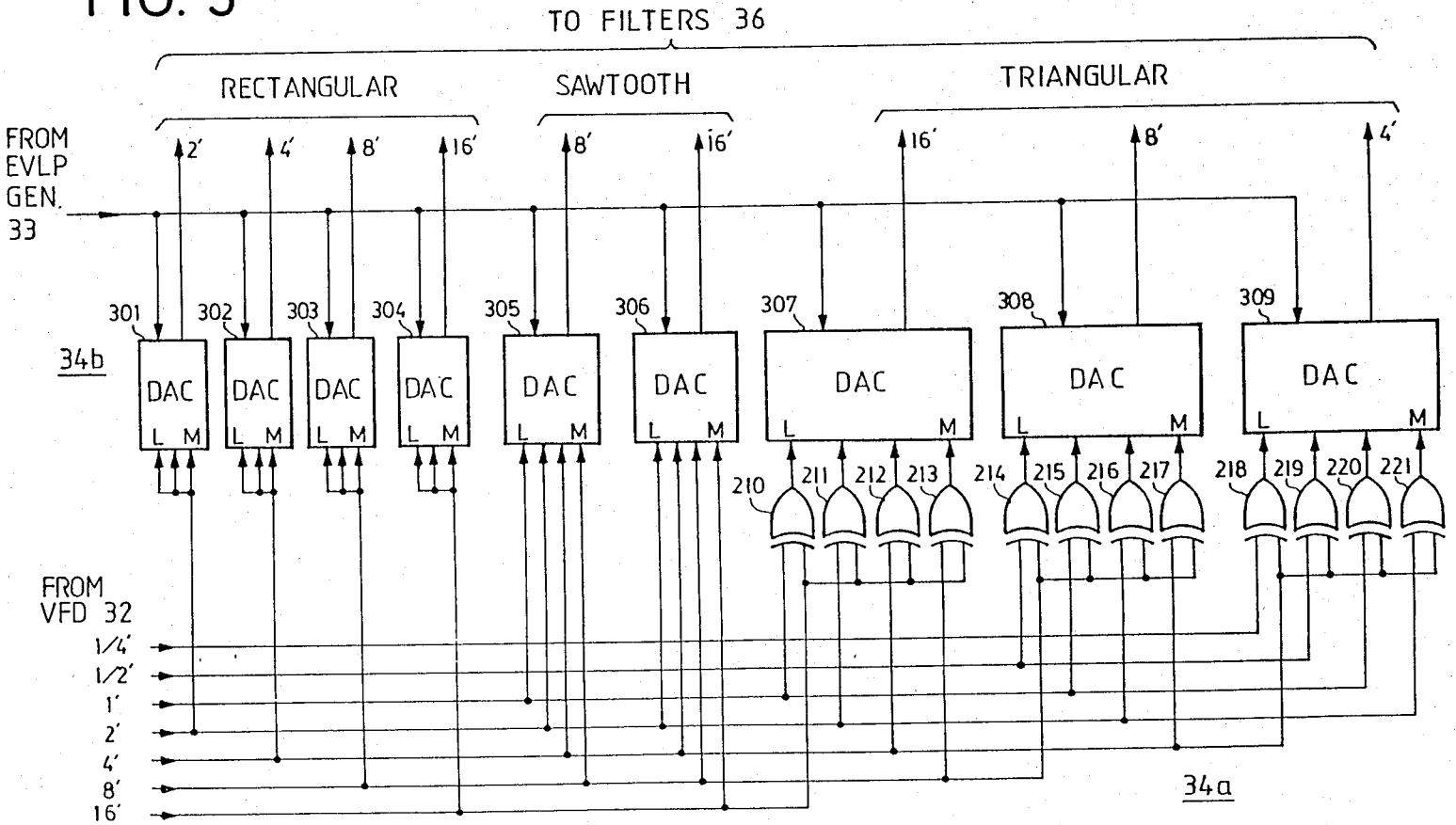
FIG. 5 is an illustration of the detail of the logic network and digital-analog converters of FIG. 1*b;*

The outputs of the flip-flops 83 to 89 are applied through a logic network 34*a* to digital-analog converters 34*b* shown in FIG. 5 to produce the tonal qualities (timbres) to give the desired musical effects. The logic network 34*a* includes Exclusive-OR gates 210 to 221 and DA converters 34*b* are divided into a first group of three-bit DA converters 301 to 304, a second group of four-bit DA converters 305 and 306 and a third group of four-bit DA converters 307 to 309. All of these DA converters are supplied with a reference voltage from the envelope generator 33, the detail of which will be described later.

Figure 6:
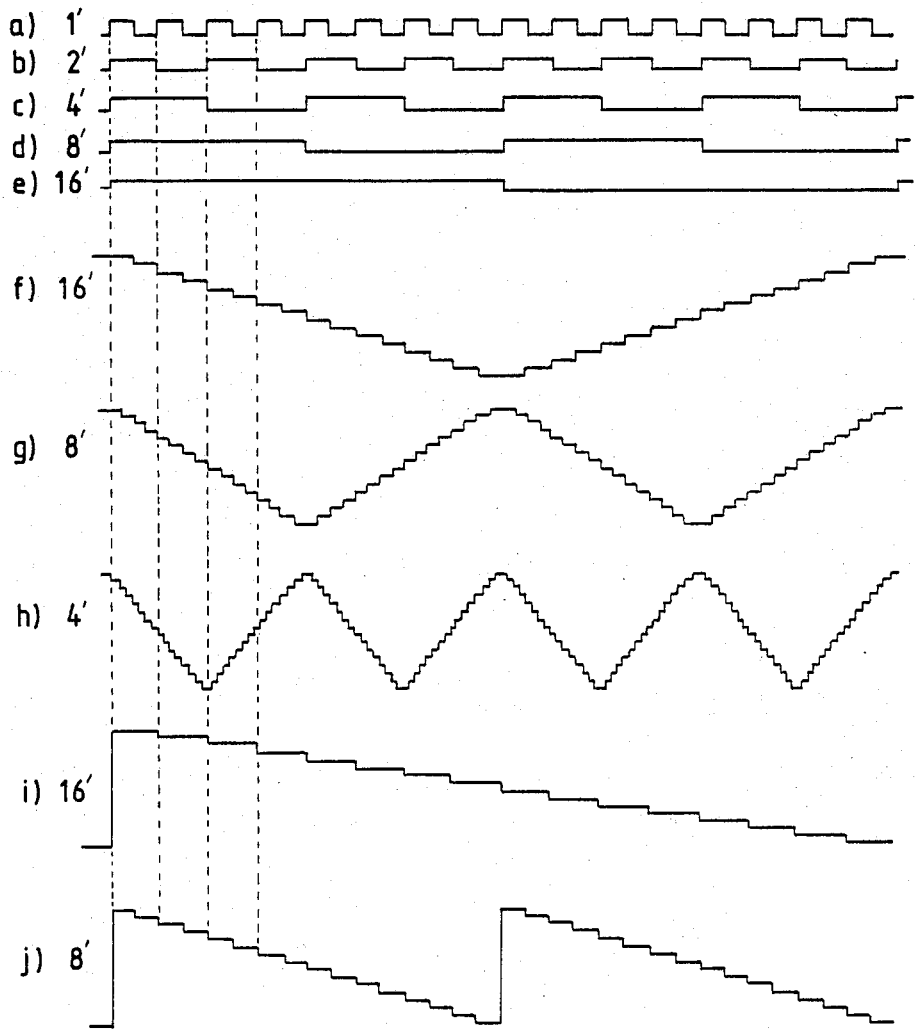
FIGS. 6*a*–j are waveform diagrams associated with FIG. 5.

The DA converters 301 to 304 are connected to receive octave signals 2', 4', 8' and 16'. Each of the DA converters 301 to 304 has its own input terminals connected together to generate a rectangular waveform. The DA converter 305 has its input terminals coupled to the 1', 2', 4' and 8' octave terminals respectively and DA converter 306 has its inputs coupled to the 2', 4', 8' and 16' octave terminals to generate sawtooth waves as shown in FIGS. 6*i* and 6*j*. The DA converters 307 to 309 receives the octave signals through Exclusive-OR gates 210 to 221. Exclusive-OR gates 210 to 213 have their first inputs coupled respectively to the 1', 2', 4' and 8' octave terminals and their second inputs coupled together to the 16' octave terminal and apply their outputs to the LSB (least significant bit) to MSB (most significant bit) terminals of DA converter 307 to generate a 16' triangular wave signal as shown in FIG. 6*f*. Exclusive-OR gates 214 to 217 have their first inputs coupled respectively to the $\frac{1}{2}'$, 1', 2' and 4' octave terminals and their second inputs coupled together to the 8' octave terminal and apply their outputs to the LSB to MSB terminals of DA converter 308 to generate an 8' triangular wave signal as shown in FIG. 6*g*. Similarly, Exclusive-OR gates 218 to 221 have their first inputs coupled respectively to the $\frac{1}{4}'$, $\frac{1}{2}'$, 1' and 2' octave terminals and their second inputs coupled together to the 4' octave terminal and apply their outputs to the LSB to MSB terminals of DA converter 309 to generate a 4' triangular wave signal as shown in FIG. 6*h*.

Figure 7A:
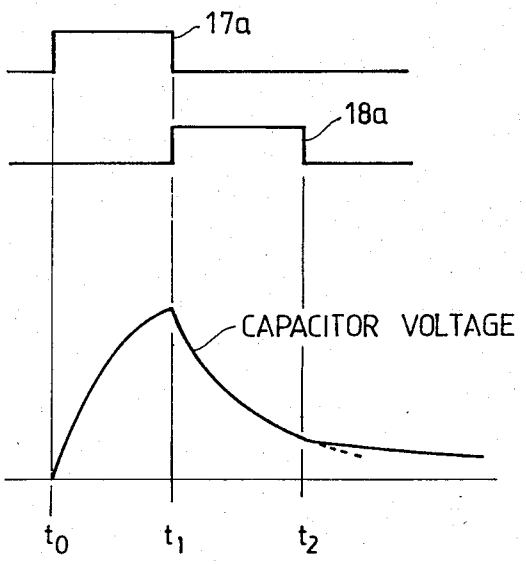
FIG. 7 is a circuit diagram of the envelope generator of FIG. 1*b*.
FIG. 7*b* is a waveform diagram associated therewith.
Figure 7:
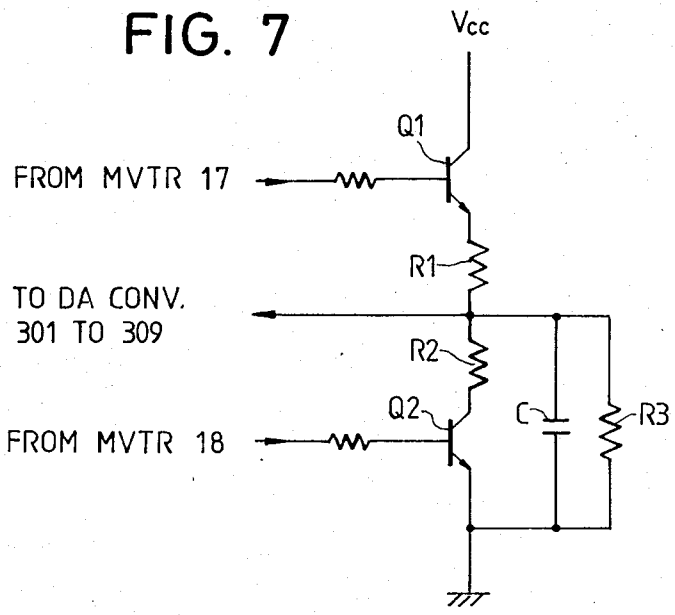

In FIG. 7, one example of the envelope generator 33 is shown. This envelope generator comprises a pair of transistors Q1 and Q2 having their collector-emitter paths connected in series between a voltage source Vcc and ground with a series combination of resistors R1 and R2 between the emitter of Q1 and the collector of Q2. A parallel combination of a capacitor C and a resistor R3 is connected between the junction of resistors R1, R2 and ground. The resistor R1 has a much larger resistance value than resistor R3. The bases of transistors Q1 and Q2 are connected respectively to the true and complementary outputs of the monostable multivibrator 17.

When a key is struck on the keyboard 10, the monostable 17 is activated at time $t_0$ (FIG. 7*a*) applying a pulse 17*a* to the base of transistor Q1, the capacitor C is charged through resistor R1 and the voltage thereacross rises with a time constant R1×C. Immediately following the trailing edge of the pulse 17*a*, the transistor Q1 is turned off at time $t_1$ and the monostable 18 is activated to produce a pulse 18*a* which is applied to the base of transistor Q2. The energy stored on capacitor C is discharged through resistors R2 and R3 during the period between times $t_1$ and $t_2$. At time $t_2$ and thereafter, the transistor Q2 is turned off and the capacitor C is discharged through resistor R3. The voltage across the capacitor C, shown in FIG. 7*a*, is applied to the DA converters 301 to 309. Alternatively, a digital-to-analog converter could equally be as well used to generate an envelope signal.

What is claimed is:

1. An electronic musical instrument having a keyboard comprising:

code generating means responsive to the operation of each of the keys on said keyboard for generating a first code indicating a pitch tone and a second code indicating an octave associated with the operated key, said first code including an odd number signal and an even number signal respectively indicating that an integer by which the frequency of said master clock pulses is divided is odd or even;

an oscillator for generating master clock pulses at a constant frequency;

a first variable frequency divider presettable to a first count value which is variable as a function of said first code for dividing the frequency of said master clock pulses by counting the same and generating a first divider output when said first count value is reached, said first variable frequency divider comprises:

first counter means including a series of interconnected counter stages presettable to said first count value for counting said master clock pulses and generating an output pulse when said first count value is reached;

second counter means for counting said master clock pulses upon a first occurrence of said output pulse for resetting said counter stages to said first count value when a first predetermined additional value is counted and upon a second occurrence of said output pulse for resetting said counter stages to said first count value when a second predetermined additional value is counted, there being a difference of one count between said first and second predetermined additional values in the presence of said odd number signal and there being no difference therebetween in the presence of said even number signal; and bistable means responsive to said output pulse for generating said first divider output at a first voltage level in response to the first occurrence of said output pulse and at a second voltage level in response to the second occurrence of said output pulse;

a second variable frequency divider responsive to said first divider output and presettable to a second count value which is variable as a function of said second code for dividing ' the frequency of said first divider output by counting the same and generating a plurality of pulse trains having octave frequency relationship; and digital-to-analog converting means for converting said pulse trains into an analog signal.

2. An electronic musical instrument as claimed in claim 1, wherein said second counter means comprises:

a shift register having first and second flip-flops successively connected to said first counter means for shifting the output pulse therefrom in response to said master clock pulses; and logic gate means responsive to said odd number signal and to the output of said first flip-flop during a first period prior to said first occurrence for resetting said first counter means and responsive to said odd number signal and to the output of said second flip-flop during a second period between said first and second occurrences for resetting said counter stages and responsive to said even number signal and to the output of said second flip-flop for resetting said counter stages during said first and second periods.

3. An electronic musical instrument as claimed in claim 2, wherein said bistable means is a third flip-flop having an input terminal connected to the output of said second flip-flop and first and second mutually complementary output terminals connected respectively to the input terminal of said second variable frequency divider and to said logic gate means, said logic gate means including a coincidence gate responsive to the binary state of the second output terminal of said third flip-flop and to the binary state of said odd and even number signals for generating a signal to define said first and second periods.

4. An electronic musical instrument as claimed in claim 1, wherein said second variable frequency divider comprises:

a series of interconnected flip-flops for generating a plurality of octave signals; and means for selectively applying said first divider output to one of the flip-flops in response to said second code.

5. An electronic musical instrument as claimed in claim 4, wherein said second variable frequency divider further comprises means for resetting a flip-flop which preceeds said one flip-flop upon the application of said first divider output thereto.

6. An electronic musical instrument as claimed in claim 1, wherein said digital-to-analog converting means comprises means for generating a predetermined waveform in response to the operation of a key on said keyboard, and means for converting said pulse trains into an analog signal and modulating the intensity of the analog signal as a function of said waveform.

7. An electronic musical instrument as claimed in claim 6, wherein said digital-to-analog converting means further comprises a logic network through which said pulse trains are applied to said converting means for shaping said analog signal into a desired waveform.

8. An electronic musical instrument having a keyboard, comprising:

a code generator responsive to each key stroke on said keyboard for generating a first code indicating a pitch tone and a second code indicating an octave associated with the key operated;

an oscillator for generating master clock pulses at a constant frequency;

a first variable frequency divider for dividing the frequency of the master clock pulses as a function of said first code to generate a first divider output;

a second variable frequency divider for dividing the frequency of said first divider output as a function of said second code to generate a plurality of pulse trains having octave frequency relationships to one another;

a first digital-to-analog converter having plural digital input terminals having different binary significance and an analog output terminal;

a logic for respectively applying said pulse trains to said input terminals of said first digital-to-analog converter such that the pulse trains of lower frequencies are applied to said input terminals of higher binary significance and the pulse trains of higher frequencies are applied to the input terminals of lower binary significance for generating a desired waveform at said analog output terminal; and a second digital-to-analog converter having plural digital input terminals having different binary significance and an analog output terminal, wherein said logic network include a plurality of Exclusive-OR gates each having a pair of first and second input terminals, the first input terminals of the Exclusive-OR gates being supplied with the pulse train having the lowermost frequency of said pulse trains and the second input terminals of the Exclusive-OR gates being supplied respectively with the pulse trains other than said lowermost frequency pulse train, the output terminals of said Exclusive-OR gates being connected to said second digital-to-analog converter respectively such that the pulse trains of lower frequencies applied to said second terminals of said Exclusive-OR gates appear at the input terminals of said second digital-to-analog converter having higher binary significance.

9. An electronic musical instrument as claimed in claim 8, further comprising an envelope generator responsive to each key stroke to modify the output signals of said first and second digital-to-analog converters.

10. An electronic musical instrument as claimed in claim 8, wherein said first code includes an odd number signal and an even number signal respectively indicating that an integer by which the frequency of said master clock pulses is divided is odd or even, wherein said first variable frequency divider comprises:

first counter means including a series of interconnected counter stages presettable to said first count value for counting said master clock pulses and generating an output pulse when said first count value is reached;

second counter means for counting said master clock pulses upon a first occurrence of said output pulse for resetting said counter stages to said first count value when a first predetermined additional value is counted and upon a second occurrence of said output pulse for resetting said counter stages to said first count value when a second predetermined additional value is counted, there being a difference of one count between said first and second predetermined additional values in the presence of said odd number signal and there being no difference therebetween in the presence of said even number signal; and bistable means responsive to said output pulse for generating said first divider output at a first voltage level in response to the first occurrence of said output pulse and at a second voltage level in response to the second occurrence of said output pulse and applying said first divider output to an input terminal of said second variable frequency divider.

11. An electronic musical instrument as claimed in claim 10, wherein said second counter means comprises:

a shift register having first and second flip-flops successively connected to said first counter means for shifting the output pulse therefrom in response to said master clock pulses; and logic gate means responsive to said odd number signal and to the output of said first flip-flop during a first period prior to said first occurrence for resetting said first counter means and responsive to said odd number signal and to the output of said second flip-flop during a second period between said first and second occurrences for resetting said counter stages and responsive to said even number signal and to the output of said second flip-flop for resetting said counter stages during said first and second periods.

12. An electronic musical instrument as claimed in claim 11, wherein said bistable means is a third flip-flop having an input terminal connected to the output of said second flip-flop and first and second mutually complementary output terminals connected respectively to the input terminal of said second variable frequency divider and to said logic gate means, said logic gate means including a coincidence gate responsive to the binary state of the second output terminal of said third flip-flop and to the binary state of said odd and even number signals for generating a signal to define said first and second periods.

13. An electronic musical instrument as claimed in claim 8, wherein said second variable frequency divider comprises:

a series of interconnected flip-flops for generating a plurality of octave signals; and means for selectively applying said first divider output to one of the flip-flops in response to said second code.

14. An electronic musical instrument as claimed in claim 13, wherein another of said series interconnected flip-flops precedes said one flip-flop, said second variable frequency divider further comprising means for resetting said another flip-flop which precedes said one flip-flop upon the application of said first divider output thereto.

* * * * *